US007298336B2

(12) United States Patent
Chen et al.

(10) Patent No.: US 7,298,336 B2
(45) Date of Patent: Nov. 20, 2007

(54) ANTENNA STRUCTURE FOR OPERATING MULTI-BAND SYSTEM

(75) Inventors: Yun-Ta Chen, Taipei (TW); Yen-Liang Kuo, Taipei (TW)

(73) Assignee: High Tech Computer Corp., Taoyuan (TW)

( * ) Notice: Subject to any disclaimer, the term of this patent is extended or adjusted under 35 U.S.C. 154(b) by 113 days.

(21) Appl. No.: 11/186,989

(22) Filed: Jul. 22, 2005

(65) Prior Publication Data

US 2006/0238424 A1 Oct. 26, 2006

(30) Foreign Application Priority Data

Apr. 25, 2005 (TW) ..... 94113161 A

(51) Int. Cl.
*H01Q 1/24* (2006.01)

(52) U.S. Cl. ..... 343/702; 343/873

(58) Field of Classification Search ..... 343/702, 343/873

See application file for complete search history.

(56) References Cited

U.S. PATENT DOCUMENTS 5,341,149 A * 8/1994 Valimaa et al. ..... 343/895
6,642,907 B2 * 11/2003 Hamada et al. ..... 343/873
6,724,347 B2 * 4/2004 Tomomatsu et al. . 343/700 MS
2004/0263397 A1 * 12/2004 Noro et al. ..... 343/702
2005/0206570 A1 * 9/2005 Rousu et al. ..... 343/702

* cited by examiner

*Primary Examiner*—Tan Ho
(74) *Attorney, Agent, or Firm*—Rosenberg, Klein & Lee

(57) ABSTRACT

An antenna structure for operating multi-band system is disclosed. The antenna structure at least comprises a first radiation metal wire and a second radiation metal wire. These radiation metal wires send signal through the same feed point and provide a ground surface. The radiation metal wires are embedded into the circuit board having a hole. The design avoids the complexity of the antenna structure, reduces cost, and improves production capabilities. The length of the first radiation metal wire is bigger than the second radiation metal wire for using in a low frequency operating band and the second radiation metal wire is used in a high frequency operating band. These radiation metal wires can be fixed into the hole of the circuit board. The entwining of the radiation metal wires can bend according to a space provided by a case. Therefore, the antenna structure can be protected by the case without damages from outside forces.

20 Claims, 8 Drawing Sheets

ANTENNA STRUCTURE FOR OPERATING MULTI-BAND SYSTEM

FIELD OF THE INVENTION

The present invention generally relates to an antenna structure for operating multi-band system, and more particularly relates to a circuit board having a hole for fixing the antenna structure, and further comprising radiation metal wires to correspond with outer spaces for bending suitably.

BACKGROUND OF THE INVENTION

The role of antennas in wireless communication devices is to transmit and to receive data of wireless system. General speaking, the antenna design in mobile phones and Personal Digital Assistances (PDA) can be a traditional planner antenna or a monopole antenna and further can be a helical antenna, However, the planner antenna uses a base having dielectric constants for supporting that does not only increase cost but also increases complexity. The radiation bandwidth of the planner antenna is not better than the monopole antenna. The monopole antenna takes a characteristic with Omni-Directional Radiation Pattern. Referring to FIG. 1, a distribution diagram of an example of omni-directional radiation pattern of a prior art monopole antenna is illustrated. The helical antenna is an uncovered structure that suffers damages easily.

Referring to FIG. 2, a schematic diagram of an example of a prior art helical antenna is illustrated. The helical antenna comprises a helical antenna 21, a feed point 22, and a feed wire 23. The helical antenna is used to transmit and to receive signal in a single band. The feed wire 23 provides a feed point 22 for coupling the helical antenna 21. Due to the characteristics of mentioned above, there must be a case for containing the monopole antenna.

Because of the frequency sections are opened gradually, wireless communication devices start to do receiving integration in different frequency sections. The integration development of the antenna is used to receive wireless signal of different frequency sections and is an application of the wideband antenna. Therefore, the monopole antennas of two different frequency sections are integrated into a wideband antenna that appears in the wireless communication field. Furthermore, there is also a module design for antenna carrier support.

Referring to FIG. 3, a schematic diagram of an example of an antenna carrier support of a prior art wideband antenna is illustrated. The wideband of the antenna carrier support comprises an antenna base 31, a feed point 32 a low frequency radiation metal wire 33, and a high frequency radiation metal wire 34. The antenna base 31 is used to support the wideband antenna that comprises the low frequency radiation metal wire 33 and the high frequency radiation metal wire 34. The antenna base 31 also provides a feed point 32 to couple to the wideband antenna and still has capacity to accept other components. However, the characteristics of mentioned above increase complexity of wireless communication devices and raises costs. There must be some ways to resolve the problem.

SUMMARY OF THE INVENTION

Therefore, an object of the present invention is to provide an antenna structure for operating multi-band system. The antenna structure is applied on a base having at least one hole. The antenna structure comprises at least one feed wire that is set on the base to form a feed point and at least one radiation metal wire that is embedded the hole. The radiation metal wire has a feed terminal for coupling the feed point. The radiation metal wire further has a ground surface that is set on the base and couples to an outer ground conductor of the feed wire. The feed wire covered by the outer ground conductor is a feed coaxial transport wire. The base can be a circuit board that is composed by any form. The hole can be set on the border of the base or into the inside of the base. The radiation metal wire has a first radiation metal wire and a second radiation metal wire. The feed terminal of the first radiation metal wire couples to the feed point. The second radiation metal wire has a start terminal for coupling the first radiation metal wire near the feed terminal. The radiation metal wire does not touch with the base except the feed terminal and a touch point is embedded into the hole. The radiation metal wire is to extend and to bend freely according to a space formed by a case. In addition, the length of the first radiation metal wire is bigger than the second radiation metal wire that has a certain length for corresponding with a first operating band in order to receive or send the signal of the first operating band. The second radiation metal wire is smaller than the first radiation metal wire that has a certain length for corresponding with a second operating band in order to receive or send the signal of the second operating band. The first operating band can be a low frequency operating band and the second operating band can be a high frequency operating band.

DETAILED DESCRIPTION OF THE PREFERRED EMBODIMENTS

To make it easier for our examiner to understand the objective of the invention, its innovative features and performance, a detailed description and technical characteristics of the present invention are described together with the drawings as follows.

Figure 1:
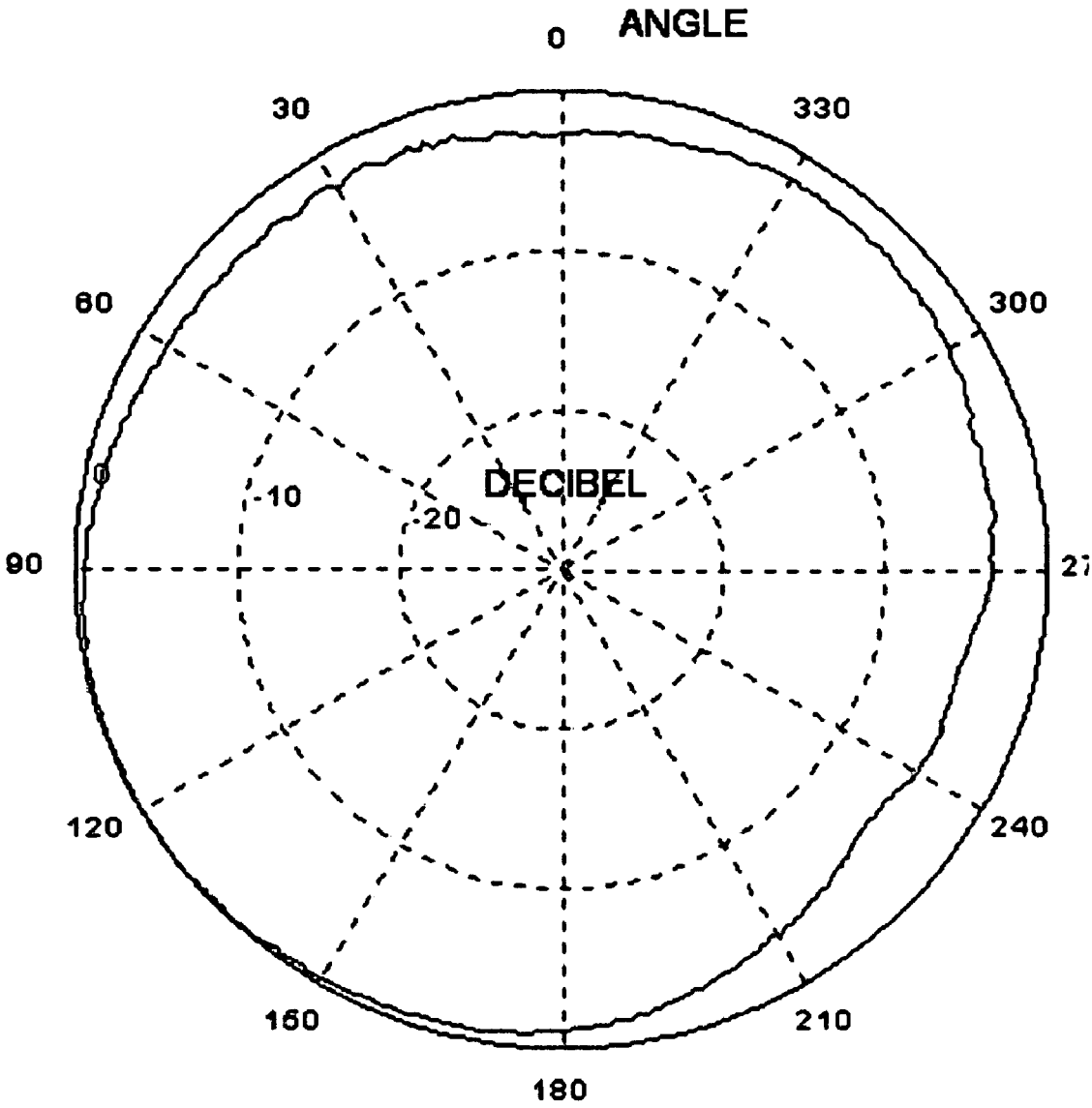
FIG. 1 is a distribution diagram of an example of omni-directional pattern of a prior art monopole antenna.
Figure 2:
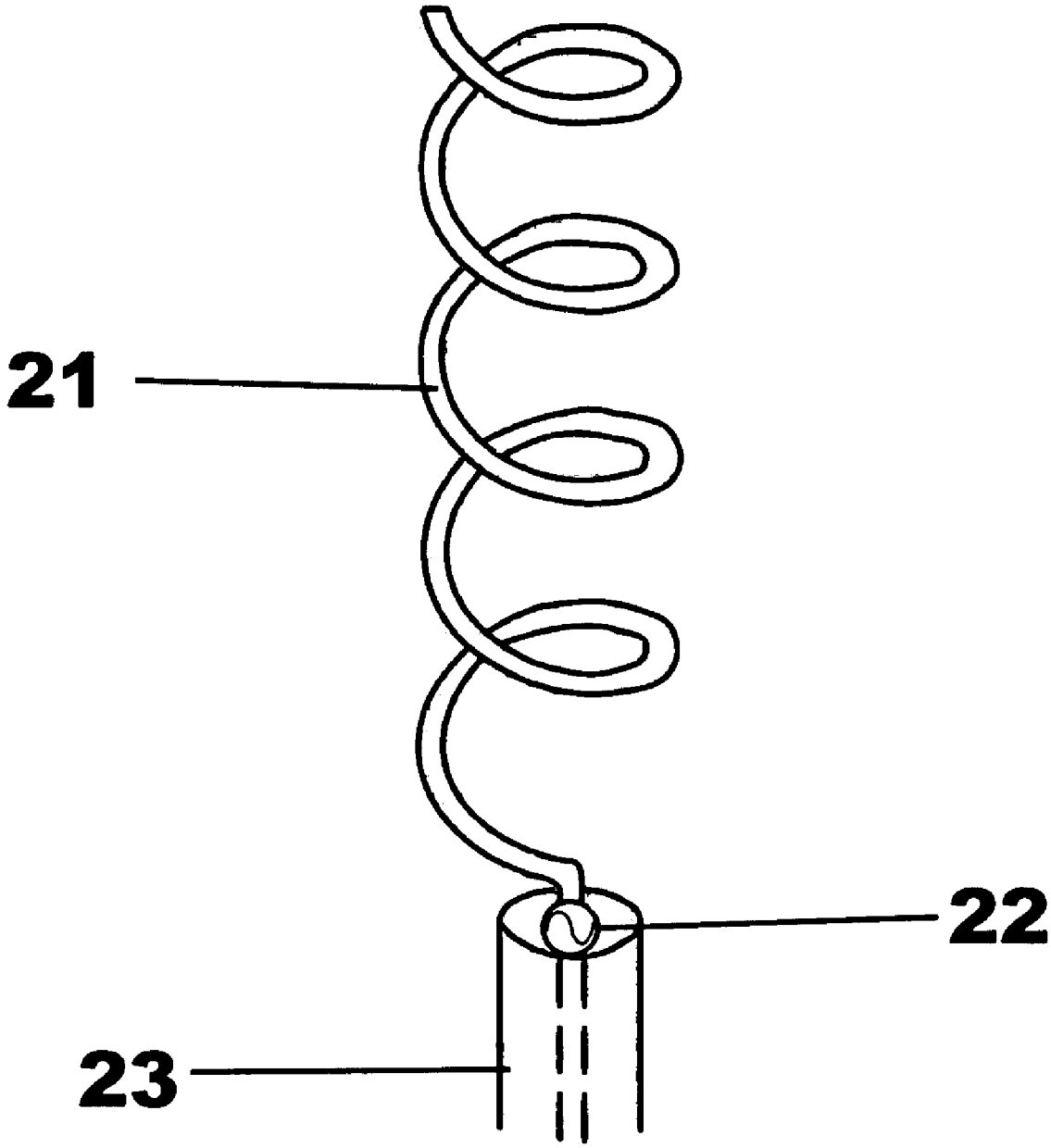
FIG. 2 is a schematic diagram of an example of a prior art helical antenna.
Figure 3:
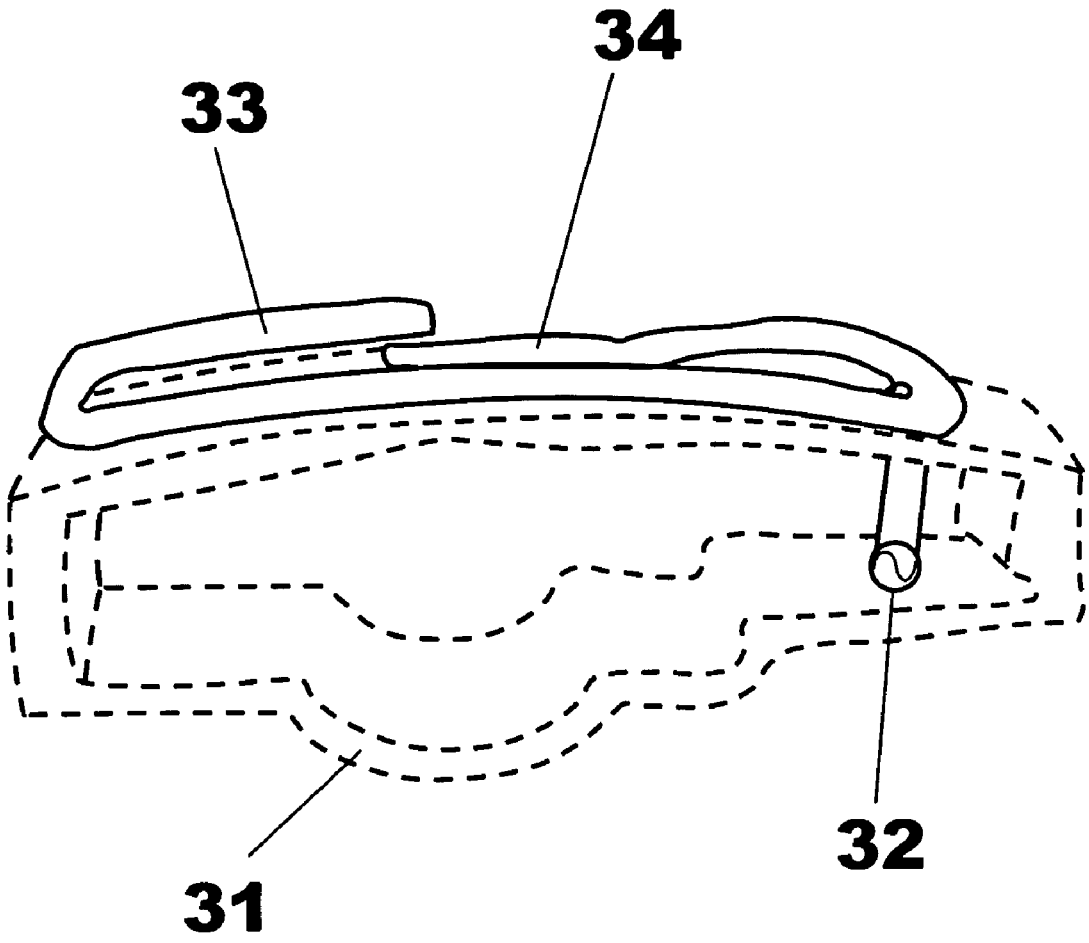
FIG. 3 is a schematic diagram of an example of an antenna carrier support of a prior art wideband antenna.
Figure 4:
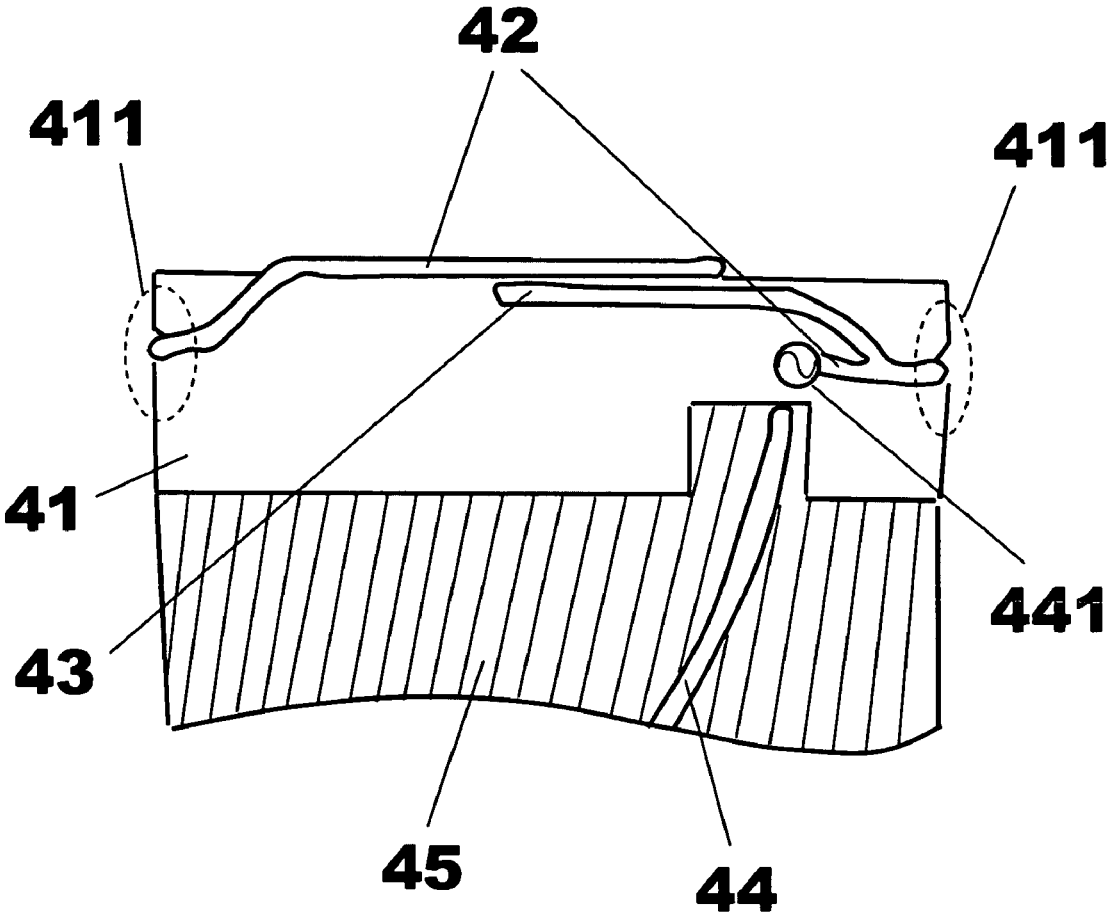
FIG. 4 is a lateral view of an example of an antenna structure for operating multi-band system according to an embodiment of the present invention.
Figure 5:
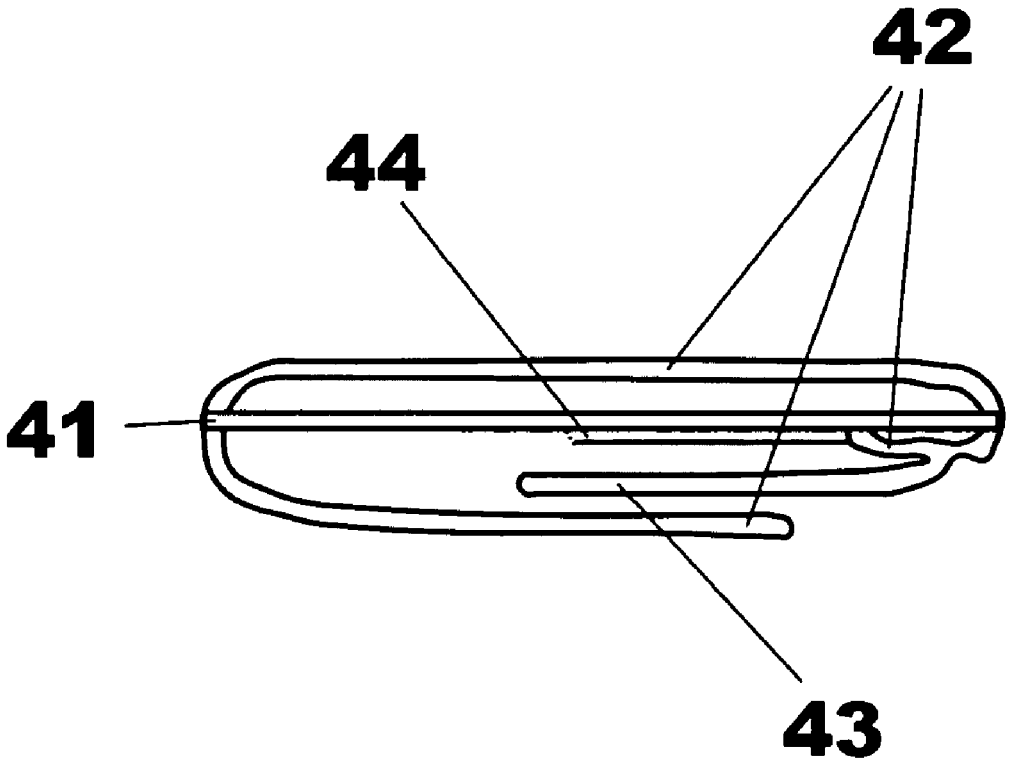
FIG. 5 is a vertical view of an example of an antenna structure for operating multi-band system according to an embodiment of the present invention.
Figure 6:
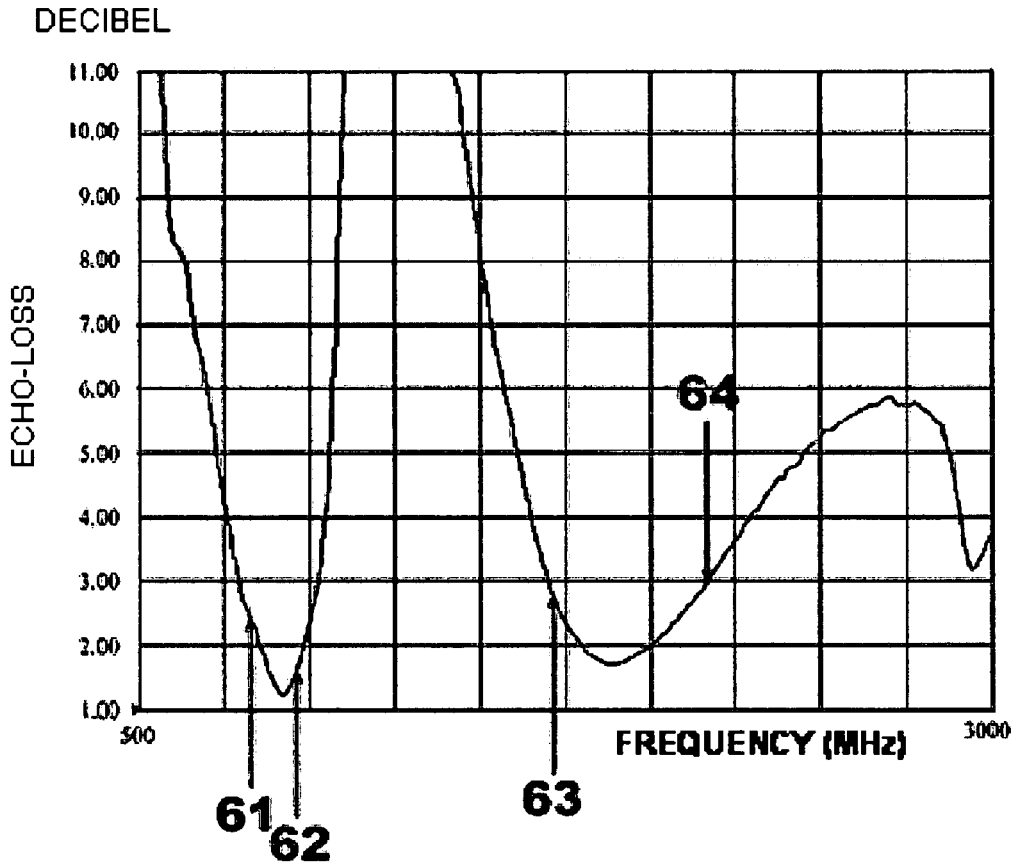
FIG. 6 is an experiment result of a return loss and a voltage standing wave ratio of an antenna structure for operating multi-band system according to an embodiment of the present invention.

Referring to FIG. 4 and FIG. 5, a lateral view and a vertical view of examples of an antenna structure for operating multi-band system according to embodiments of the present invention are illustrated. The antenna structure for operating multi-band system comprises a circuit board 41, a first radiation metal wire 42, a second radiation metal wire 43, a feed coaxial transport wire 44, and a ground surface 45. The border of the circuit board 41 has at least one hole 411 for embedding the first radiation metal wire 42 and the first radiation metal wire 42 couples to the feed point 441 provided by the feed coaxial transport wire 44. The feed coaxial transport wire 44 is composed of the feed wire covering the outer ground conductor. The second radiation metal wire 43 couples to the first radiation metal wire 42 near the feed point 441. In addition, the ground surface 45 is set on the circuit board 41. As shown in FIG. 5, the first radiation metal wire 42 and the second radiation metal wire 43 does not touch the circuit board 41 except fixing into the hole 411 and coupling to the feed point 441. The end of both radiation metal wires 42, 43 extend to the same side. The first radiation metal wire 42 is to receive and to transmit the low frequency operating band of the first operating band, such as 824-960 MHz. The second radiation metal wire 43 is to receive and to send the high frequency operating band of the second operating band, such as 1710-2170 MHz. FIG. 6 is an experiment result of a return loss and a voltage standing wave ratio of an antenna structure for operating multi-band system according to an embodiment of the present invention. The curve of point 61 to point 62 is the low frequency operating band 824 MHz-960 MHz and the curve of point 63 to point 64 is the high frequency operating band 1710 MHz-2170 MHz. Therefore, the antenna band can cover four bands of GSM (Global System for Mobile Communication) and the band of WCDMA (Wideband Code Division Multiple Access) (824-960 MHz, 1710-2170 MHz). Moreover, the high frequency band can be reached 460 MHz and return loss observation in the low frequency operating band and the high frequency operating band has a better gain of antenna radiation.

Figure 7:
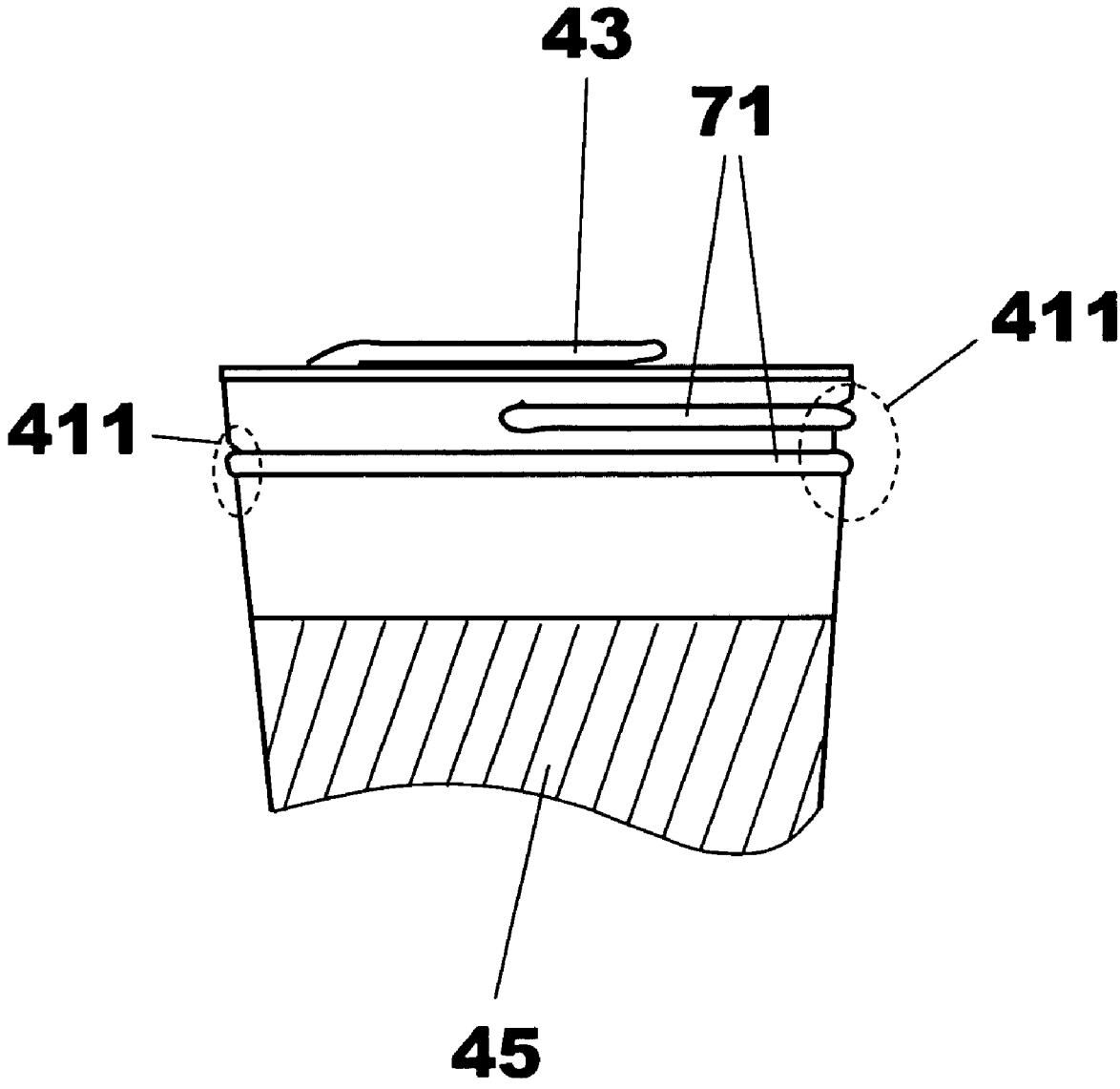
FIG. 7 is a structural drawing of an example of an antenna structure for operating multi-band system according to an embodiment of the present invention.

Referring to FIG. 7, a structural drawing of an example of an antenna structure for operating multi-band system according to an embodiment of the present invention is illustrated. The first radiation metal wire 71 is to extend from different directions from shown in FIG. 4 and FIG. 5. The extended result will take the tail of the first radiation metal wire 71 and the tail of the second radiation metal wire 43 to set at different sides.

Figure 8:
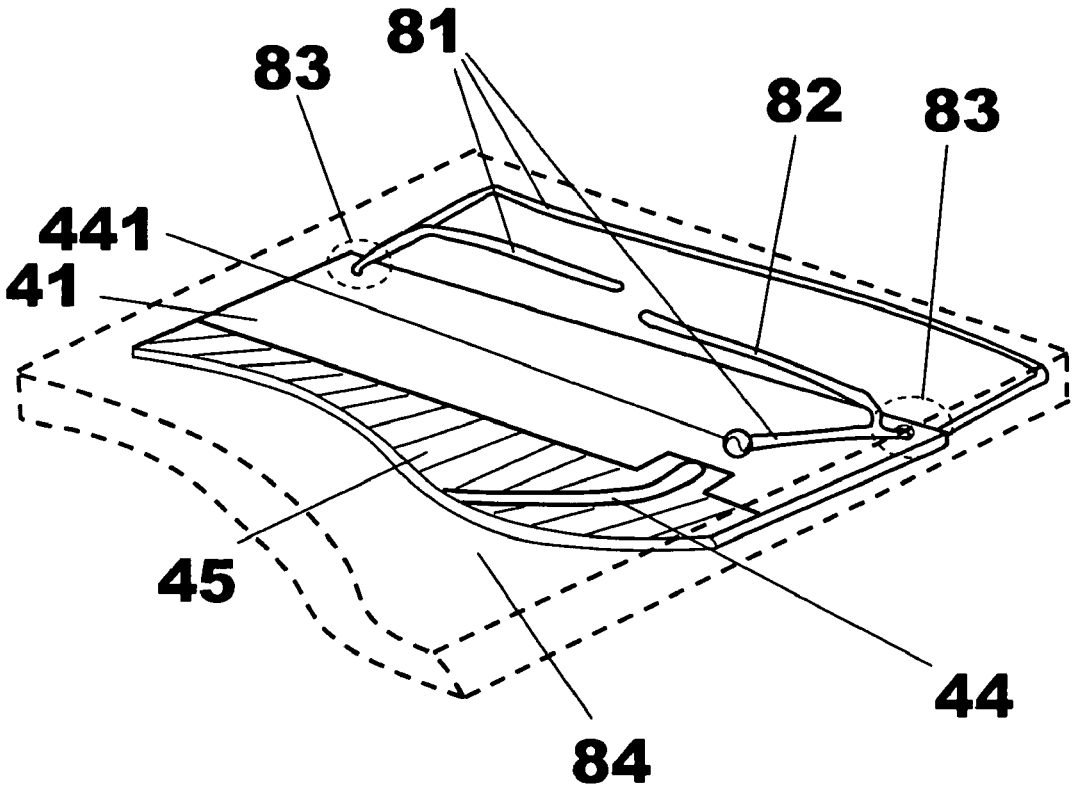
FIG. 8 is another structural drawing of an example of an antenna structure for operating multi-band system according to an embodiment of the present invention.

In addition, referring to FIG. 8, another structural drawing of an example of an antenna structure for operating multi-band system according to an embodiment of the present invention is illustrated. The circuit board 41 is set into a space of a case 84 and there is at least one hole 83 that is set into the circuit board 41 for fixing the first radiation metal wire 81. The first radiation metal wire 81 and the second radiation metal wire 82 are to extend according to the space provided by the case 84.

As mentioned above, the antenna structure uses a monopole antenna for setting structure and is hided into the case. Therefore, the advantage of the invention is to satisfy the characteristics with wideband monopole antennas and omnidirectional radiation pattern. The invention also overcomes the drawback with the uncovered structure. The invention of the antenna structure has a better gain of antenna radiation in the low frequency operating band 824 MHz-960 MHz and the high frequency operating band 1710 MHz-2170 MHz. In the apparatus characteristics, the invention uses a radiation metal wire to be a main body and uses the hole of the circuit board to fix the antenna. The design decreases complexity in the antenna module structure and the antenna is bent by metal wires without antenna carrier supports. The characteristics increase the capabilities of production and reduce cost. Another advantage of the invention is that the antenna structure can be set any shape of cases. In other words, the antenna structure can be bent freely according to any shape of cases.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the description above, the present invention is novel and useful and definite enhances the performance over the conventional structure and further complies with the patent application requirements and is submitted to the Patent and Trademark Office for review and granting of the commensurate patent rights.

What is claimed is:

1. An antenna structure comprising:

a base having at least one hole formed therein;

a feed wire coupled to said base to form a feed point; and at least one radiation metal wire having a feed terminal for coupling to said feed point, said radiation metal wire extending from said feed point in spaced relationship from said base to pass through said hole and contact said base.

2. The antenna structure of claim 1, wherein said antenna structure further comprises a ground surface that is set on said base and couples to an outer ground conductor of said feed wire.

3. The antenna structure of claim 1, wherein said base is a circuit board.

4. The antenna structure of claim 3, wherein said at least one hole is formed at a border of said circuit board for embedding said first radiation metal wire and said first radiation metal wire couples to said feed point provided by said feed coaxial transport wire.

5. The antenna structure of claim 1, wherein said radiation metal wire has a first radiation metal wire and a second radiation metal, wherein said feed terminal of said first radiation metal couples to said feed point, said second radiation metal has a start terminal for coupling to said first radiation metal wire near said feed terminal.

6. The antenna structure of claim 5, wherein said first radiation metal wire applies to a first operating band, has a certain length for corresponding with said first operating band, and the length is longer than said second radiation metal wire.

7. The antenna structure of claim 6, wherein said first operating band is a low frequency operating band.

8. The antenna structure of claim 5, wherein said second radiation wire applies to a second operating band, has a certain length for corresponding with said second operating band, and the length is shorter than said first radiation metal wire.

9. The antenna structure of claim 8, wherein said second operating band is a high frequency operating band.

10. The antenna structure of claim 1, wherein said feed point is a feed coaxial transport wire including: an outer ground conductor covering an inner feed wire conductor.

11. An antenna structure comprising:

a base having at least one recess formed in an edge thereof;

a feed wire coupled to said base to form a feed point; and at least one radiation metal wire being coupled to said feed point, said radiation metal wire extending from said feed point to pass through said recess and contact said base.

12. The antenna structure of claim 11, wherein said antenna structure further comprises a ground surface that is set on said base and couples to an outer ground conductor of said feed wire.

13. The antenna structure of claim 11, wherein said base is a circuit board.

14. The antenna structure of claim 11, wherein the extension direction of said radiation metal wire bends freely in spaced relation with said base.

15. The antenna structure of claim 11, wherein said radiation metal wire has a first radiation metal wire and a second radiation metal, wherein said feed terminal of said first radiation metal couples to said feed point, said second radiation metal has a start terminal for coupling to said first radiation metal wire near said feed terminal.

16. The antenna structure of claim 15, wherein said first radiation metal wire applies to a first operating band, has a certain length for corresponding with said first operating band, and the length is longer than said second radiation metal wire.

17. The antenna structure of claim 16, wherein said first operating band is a low frequency operating band.

18. The antenna structure of claim 17, wherein said second radiation wire applies to a second operating band, has a certain length for corresponding with said second operating band, and the length is shorter than said first radiation metal wire.

19. The antenna structure of claim 18, wherein said second operating band is a high frequency operating band.

20. The antenna structure of claim 11, wherein said feed point is a feed coaxial transport wire including:

an outer ground conductor covering an inner feed wire conductor.

* * * * *